US011745993B2

(12) United States Patent
Campagnone

(10) Patent No.: US 11,745,993 B2
(45) Date of Patent: Sep. 5, 2023

(54) VERSATILE FUNNEL

(71) Applicant: Anthony Campagnone, N. Andover, MA (US)

(72) Inventor: Anthony Campagnone, N. Andover, MA (US)

( * ) Notice: Subject to any disclaimer, the term of this patent is extended or adjusted under 35 U.S.C. 154(b) by 65 days.

(21) Appl. No.: 17/510,513

(22) Filed: Oct. 26, 2021

(65) Prior Publication Data

US 2022/0127127 A1 Apr. 28, 2022

Related U.S. Application Data

(60) Provisional application No. 63/105,808, filed on Oct. 26, 2020.

(51) Int. Cl.
*B67C 11/00* (2006.01)

(52) U.S. Cl.
CPC ..... *B67C 11/00* (2013.01)

(58) Field of Classification Search
CPC ..... B67C 11/00; B67C 11/02
USPC ..... 141/331, 337, 338
See application file for complete search history.

(56) References Cited

U.S. PATENT DOCUMENTS

| | | | | |
|---|---|---|---|---|
| 5,511,595 | A * | 4/1996 | Stidham | B67C 11/04 141/297 |
| 5,960,907 | A * | 10/1999 | Chau | B67C 11/00 141/97 |
| 5,979,516 | A * | 11/1999 | Grant | F01M 11/0408 141/331 |
| 7,635,013 | B2 * | 12/2009 | Ballinger | B67C 11/00 141/331 |
| 9,758,080 | B2 * | 9/2017 | Goldman | B60N 3/101 |
| 2016/0130042 | A1 * | 5/2016 | Gascoine | B65D 25/14 220/288 |

* cited by examiner

*Primary Examiner* — Jason K Niesz
(74) *Attorney, Agent, or Firm* — Tod A. Kupstas

(57) ABSTRACT

A versatile funnel is adapted to have many uses and be easily storable. In an embodiment, the versatile funnel is adapted to be collapsible. In an embodiment, the versatile funnel is adapted to be magnetically secured to locations, such as the hood of a vehicle, a cabinet, or an appliance.

17 Claims, 2 Drawing Sheets

VERSATILE FUNNEL

This application claims the benefit of U.S. Provisional Patent Application Ser. No. 63/105,808 filed Oct. 26, 2020, the contents of which are incorporated herein by reference.

BACKGROUND

1. Field

This application is directed to the field of tools. In particular, the application is directed to a funnel.

2. Description of the Related Art

Funnels exist in many different types of forms. Disposable funnels exist, as well as more permanent types of funnels. Many funnels are single use type funnels or are dedicated for a particular task or situation. Many are not able to be implemented in different situations. Further, frequently funnels may be misplaced.

Therefore, there remains a need in the field to be able to provide a funnel that is capable of being easily stored, retrieved, durable, and able to serve multiple uses.

SUMMARY

Briefly described, aspects of the present disclosure relate to a versatile funnel.

An aspect of the present disclosure is a funnel. The funnel has a conical shaped body portion having a top opening that has a larger circumference than a bottom opening, wherein the conical shaped body portion is adapted to be collapsible; and a magnetic rim forming a circumference of the top opening, wherein the magnetic rim is adapted to be secured to another magnetic surface.

Another aspect of this disclosure is a funnel system. The funnel system having a funnel having; a body portion having a top opening that is larger than a bottom opening, wherein the body portion is adapted to be collapsible; a magnetic rim forming a perimeter of the top opening, wherein the magnetic rim is adapted to be secured to another magnetic surface, the magnetic rim comprising at least two magnetic elements embedded therein; and a magnetic component comprising a securing device and magnet that is adapted to be secured at a location where the funnel is accessible.

DETAILED DESCRIPTION

To facilitate an understanding of embodiments, principles, and features of the present disclosure, they are disclosed hereinafter with reference to implementation in illustrative embodiments. Embodiments of the present disclosure, however, are not limited to use in the described systems or methods and may be utilized in other systems and methods as will be understood by those skilled in the art.

The components described hereinafter as making up the various embodiments are intended to be illustrative and not restrictive. Many suitable components that would perform the same or a similar function as the components described herein are intended to be embraced within the scope of embodiments of the present disclosure.

Figure 1:
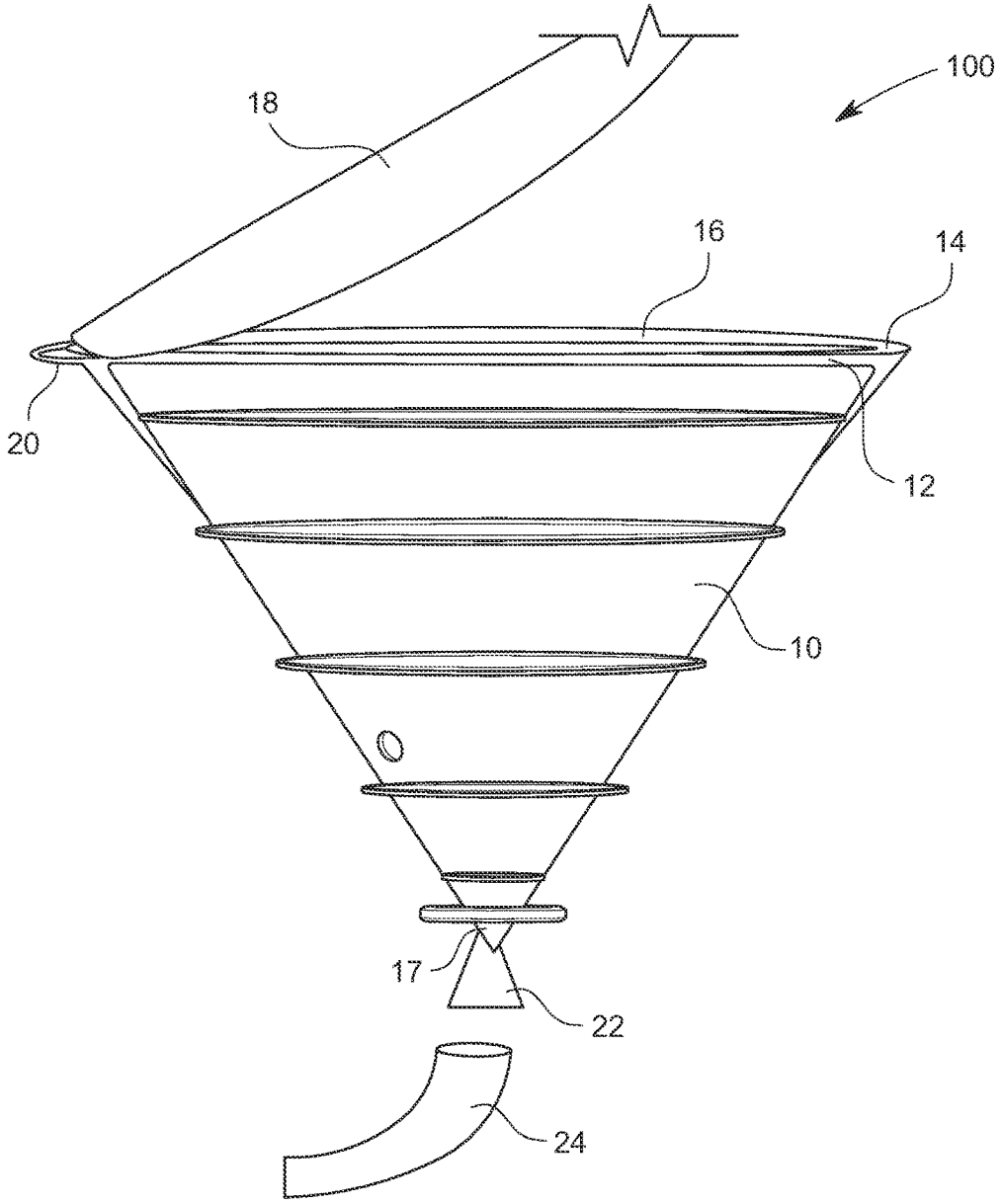
FIG. 1 is a front schematic view of a funnel that is in accordance with an embodiment of the disclosure.

Referring to FIG. 1, shown is an embodiment of funnel 100. Funnel 100 comprises a body portion 10. The body portion 10 is adapted to be funnel shaped. That is to say, the body portion has a conical shape. The conical shape means that the body portion is generally wider in the area where material enters the body portion 10 (generally referred to herein as the top of the body portion 10) than where it exits the body portion 10 (generally referred to herein as the bottom of the body portion). In an embodiment, the transition from the wider portion to the narrower portion is a constant, gradual, transition. In an embodiment, the transition from the wider portion to the narrower portion is in a stepped manner. In an embodiment, the top of the body portion is circular. In an embodiment, the top of the body portion is hexagonal. In an embodiment, the top of the body portion is pentagonal. In an embodiment, the top of the body portion is octagonal. In an embodiment, the top of the body portion has a polygonal shape. In an embodiment, the top of the body portion has a non-polygonal shape. In an embodiment, the top of the body portion is an ellipse. In an embodiment, the shape of the top of the body portion matches the shape of the bottom portion. In an embodiment, the shape of the top portion does not match the shape of the bottom portion.

The body portion 10 is adapted to take materials, such as fluids, loose solids, viscous matter, etc. and convey the materials from the top opening 16 of the body portion 10 to the portion of the body portion 10 that is at its most narrow, which is typically the bottom opening 17. The materials are typically conveyed via the force of gravity. Additionally, the momentum of the materials being poured into the funnel will also facilitate movement of the materials from the top opening 16 to the bottom opening 17.

In an embodiment, suction force is applied to the bottom opening 17 to facilitate the passage of materials through the funnel 100. In an embodiment, the walls of the body portion 10 are movable in the direction of the bottom opening 17 to facilitate passage of materials through the funnel 100. In an embodiment, magnetic material may be added to the material placed within the funnel 100 and a magnet placed at the bottom opening 17 to facilitate the movement of material through the funnel 100.

In the embodiment shown in FIG. 1, the interior of the body portion 10 may have a surface that has a minimal coefficient of friction. In an embodiment, the coefficient of friction is less than 1.0. In an embodiment, the coefficient of friction is less than 0.8. In an embodiment, the coefficient of friction is less than 0.6. In an embodiment, the coefficient of friction is less than 0.4. In an embodiment, the coefficient of friction is less than 0.2. In an embodiment, the coefficient of friction is less than 0.1. In an embodiment, the coefficient of friction is less than 0.05.

In an embodiment, the body portion 10 is adapted to be collapsible. In an embodiment, the body portion 10 is adapted to be collapsible in an accordion-like manner. In an embodiment, the body portion 10 is adapted to be collapsible in a telescopic manner. In an embodiment, the body portion 10 is collapsible via the usage of a hinged mechanism. In an embodiment, the body portion 10 is foldable. In an embodiment, the body portion 10 is adapted to fold into itself.

In an embodiment, a magnetic rim 12 is located around the top opening 16 of the body portion 10. The magnetic rim 12 is adapted to be magnetically attached to surfaces.

Figure 2:
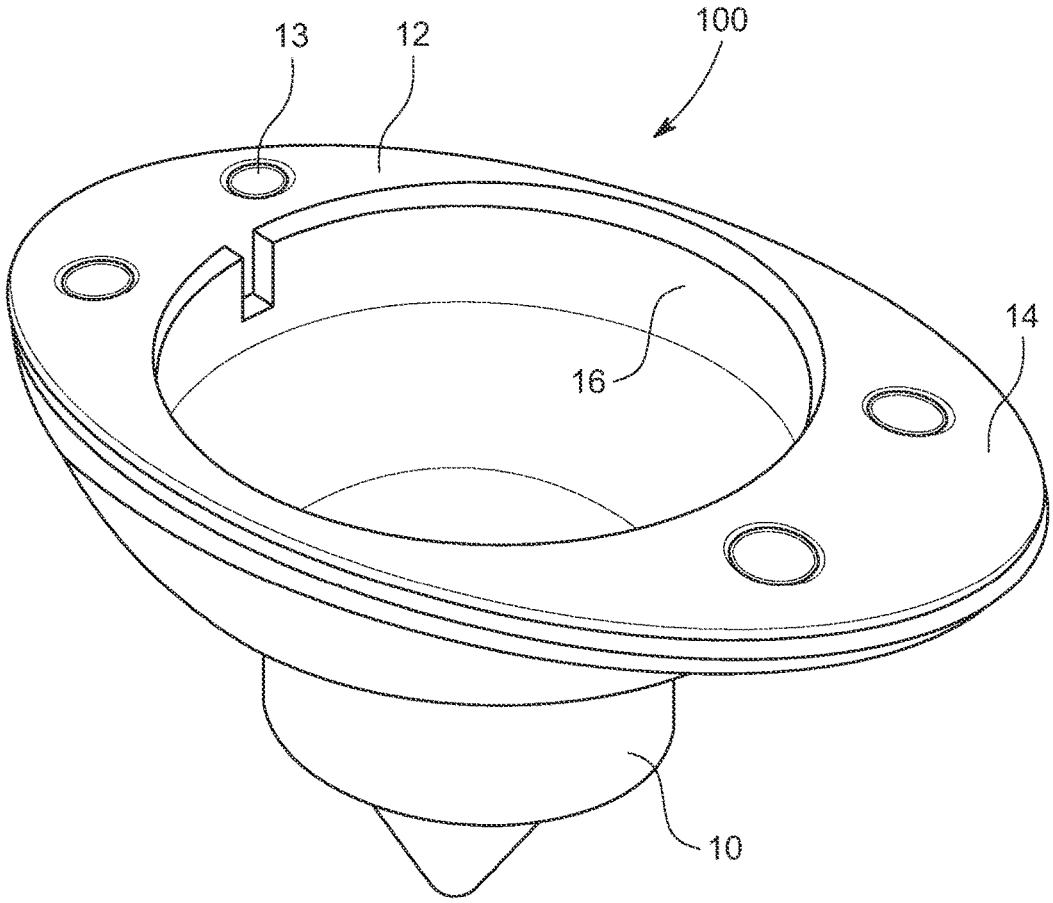
FIG. 2 is top-down isometric view of the embodiment of the funnel shown in FIG. 1.

In FIG. 2 the magnetic rim 12 has magnetic elements 13 embedded within the body of the magnetic rim 12. Still referring to FIG. 2, the magnetic elements 13 are secured within cavities formed within the body of the magnetic rim 12. In some embodiments, such as the embodiment shown in FIG. 2, only a portion of the magnetic rim 12 is magnetic.

The magnetic rim 12 shown has a circular opening. The perimeter of the magnetic rim 12 is larger in some areas than in other areas. The magnetic elements 13 are generally located in the larger surface areas of the magnetic rim 12. In the embodiment shown in FIG. 2, the magnetic rim 12 is not circular shaped, even though the body 10 has a circular cross-section, instead the magnetic rim 12 is oval (ellipse) shaped to accommodate the magnetic elements 13. With the magnetic rim 12 being oval shaped there is more material forming the magnetic rim 12 located at the ends of the oval shape.

In the embodiment shown in FIG. 2 there are four magnetic elements 13 that are located within the magnetic rim 12. In an embodiment, there are five magnetic elements located within the magnetic rim. In an embodiment, there are six magnetic elements located within the magnetic rim. In an embodiment, there are more than four magnetic elements located within the magnetic rim. In an embodiment, there are three magnetic elements located within the magnetic rim. In an embodiment, there are two magnetic elements located within the magnetic rim. In an embodiment, there are less than four magnetic elements located within the magnetic rim. It should be understood that the size and number of the magnetic elements are commensurate with the location where the funnel 100 will be stored.

In FIG. 2 the magnetic elements 13 are located with one pair being located at one of the distal ends, proximate to the finger tab 14, and another pair located at the other distal end of the magnetic rim 12. The arrangement of the magnetic elements 13 in this manner permits the funnel 100 to be magnetically attached in a stable manner. In an embodiment, the magnetic elements are equidistantly spaced around the magnetic rim 12. In an embodiment, the magnetic elements are spaced so that there is one magnetic element located proximate to the finger tab 14, one magnetic element located on the portion of the magnetic rim 12 opposite to the finger tab 14, and the other two magnetic elements located on the magnetic rim 12 equidistantly from the other two magnetic elements.

In FIG. 2, the magnetic elements 13 are disc shaped. In an embodiment, the magnetic elements are rectangular shaped. In an embodiment, the magnetic elements are formed as elongated strips. In an embodiment, the magnetic elements are square shaped. In an embodiment, the magnetic elements are triangular shaped. In an embodiment, the magnetic elements are polygonal shape.

In an embodiment, the entire rim is magnetic. In an embodiment, only a portion of the rim is magnetic. In an embodiment, more than one portion of the rim is magnetic. In an embodiment, the body portion is magnetic. In an embodiment, a portion of the body portion is magnetic. In an embodiment, more than one portion of the body portion is magnetic. In an embodiment, the magnetic elements are electromagnetic elements that are activated by moving a switch located on the funnel and providing a charge to the electromagnetic elements.

In an embodiment, the magnetic rim 12 is adapted to be attachable to the hood of a vehicle. In an embodiment, the magnetic rim 12 is adapted to be attached to a metallic table. In an embodiment, the magnetic rim 12 can be secured to a refrigerator or to the surface of a counter. In an embodiment, the magnetic rim 12 can be secured to the underside of a counter.

Figure 3:
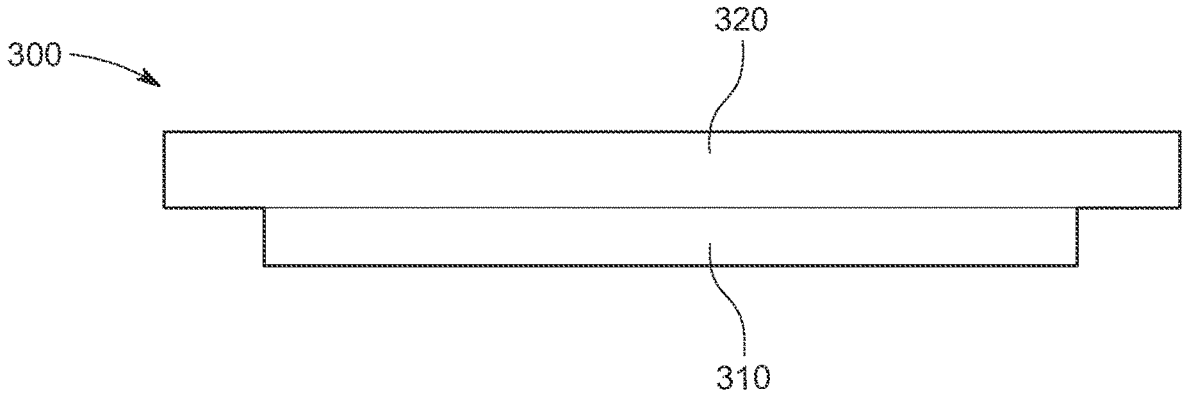
FIG. 3 is a diagram of the magnetic component.

In an embodiment, the funnel 100 may be packaged with an accompanying magnetic component, such as magnetic component 300, shown in FIG. 3. The magnetic component 300 can be adhesively attached to another surface, e.g., wall of a garage, workspace, interior of a vehicle, etc., and the magnetic rim 12 can be secured to that surface when the funnel 100 is not in use. In embodiment, the magnetic component 300 can be adhesively attached to a portion of the funnel 100, such as the body portion 10. The funnel 100 may then be magnetically secured to any other magnetic surface in a different orientation, or in the event there is no magnetic rim 12.

In an embodiment, the magnetic component 300 comprises a magnet 310 that has a securing device 320 secured on one of its surfaces. In an embodiment, the securing device 320 is hook and loop tape (aka Velcro™). In an embodiment, the securing device comprises a screw set. In an embodiment, the securing device has a chemical adhesive component.

Referring to FIGS. 1 and 2, an insert 18 may be inserted into the funnel 100 at the top opening 16 of the funnel 100. In an embodiment, the insert 18 may be a screen insert for juicing. In an embodiment, the insert 18 may be cheesecloth. In an embodiment, the insert 18 may be a mechanism for filtering particulates of certain sizes. In an embodiment, the insert 18 may be an electrically enabled or magnetically enabled insert that is adapted to filter out materials that have those types of properties. In an embodiment, the insert 18 may be integrally formed with the body of funnel, so that it may be extruded from a compartment contained therein and implemented or otherwise used.

In an embodiment, the insert 18 is treated with a material that affects the composition of that which is passing through the funnel 100. For example, if water is being passed through the funnel, a purification agent may be used to treat the insert. In an embodiment, if a food item is passed through the funnel 100, an agent for flavoring the food item is part of the insert 18. In an embodiment, an oil additive is part of the insert 18.

In an embodiment, the funnel 100 further comprises a loop 20 for attachment of insert 18. In an embodiment, the insert 18 is inserted without the need for loop 20. The loop 20 is adapted to secure the insert 18 to the body 10 of the funnel 100. In an embodiment the loop 20 has tabs located thereon that able to capture the insert 18, that has associated tab openings. In an embodiment, the loop 20 forms a ridge that is adapted to secure the insert 18.

The funnel 100 may have a finger tab 14 adapted to permit holding of the funnel 100 during use of the funnel 100.

Additionally, the funnel 100 may have an extension 22 that may be threaded. In an embodiment, the extension 22 is adapted to have a tube 24 attached thereto. In an embodiment, the extension 22 is stretchable and pliable.

In an embodiment, the extension 22 is sized to accommodate the insertion of a tube 24. In an embodiment, the tube 24 is adapted to be flexible. In an embodiment, a tube 24 may be connected via magnetic means and the extension 22 may be formed from a magnetic material. In an embodiment, the tube 24 may be connected via electrostatic means. In an embodiment, the tube 24 may be connected via mechanical means. In an embodiment, the tube 24 may be connected via electrostatic means.

In an embodiment, the tube 24 may be made of more rigid material, such as metal. In an embodiment, the tube 24 may be an attachment portion to a component of another device, such as a vehicle. In an embodiment, the tube 24 may be an attachment portion to a component of another device, such as a waste collector, or other receptacle.

In an embodiment, the funnel is made from organic materials. In an embodiment, the funnel is made of metal. In an embodiment, the funnel is made from ceramic material. In an embodiment, the funnel comprises disposable components. In an embodiment, the different components of the funnel and the funnel are made from silicone materials.

The funnel 100 may be used to replenish fluids in an automobile, or other vehicle into which fluid is needed to keep the vehicle functioning properly. The magnetic features of the funnel 100 can enable the funnel to be easily attached under hood or any metal object located on the vehicle. A compatible magnetic component can further be secured to the vehicle to permit the attachment of the funnel 100. Preferably the magnet has enough of magnetic force so that movement of the vehicle will not dislodge the funnel 100. In an embodiment, the magnetic field strength of the magnetic component is greater than 0.001 tesla. In an embodiment, the magnetic field strength of the magnetic component is greater than 0.005 tesla. In an embodiment, the magnetic component is made of neodymium.

The funnel 100 may be used in the kitchen setting. In the kitchen setting the funnel 100 may be attached to a refrigerator or another item in the kitchen. The funnel 100 can come with a separate item, such as the magnetic component discussed above, that permits the funnel 100 to be attached to a cabinet, table, or other kitchen object.

The funnel 100 can also be used in a marine setting, for implementation with boats. The funnel 100 can utilize a separate component, such as the magnetic component discussed above, to attach it to a vessel. The funnel 100 can be used for a waste receptacle for individuals who need to use smaller waste facilities where a standard bathroom for a person is not accessible. This will permit a person to discreetly relieve his or herself. The funnel 100 can also be used in to provide fluids to maintain the operation of the vessel. This embodiment can also include a collapsible bowl-shaped accessory that can be attached to the bottom of the funnel via a connector, such as a multiple foot long accordion style hose. The hose may have a female threaded end that can be used for quick connection to the bottom of the funnel 100. In an embodiment, the hose is a half-inch hose that is abouts six feet long.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A funnel comprising:

a conical shaped body portion having a top opening that has a larger circumference than a bottom opening, wherein the conical shaped body portion is adapted to be collapsible; and a magnetic rim forming a circumference of the top opening, wherein the magnetic rim is adapted to be secured to another magnetic surface;

wherein the magnetic rim is oval shaped and has more material forming portions of the oval shape on the portion of the oval shaped magnetic rim located along the longest axis of the oval shaped magnetic rim; and wherein the magnetic rim has at least four magnetic elements located on the portions of the oval shape having more material, wherein each of the at least four magnetic elements are arranged to correspond to corners of a rectangle and none of the at least four magnetic elements are located on the circumference of the top opening.

2. The funnel of claim 1, wherein the magnetic rim has a loop that is adapted to attach an insert for the funnel.

3. The funnel of claim 1, wherein the magnetic rim has a plurality of magnetic elements.

4. The funnel of claim 1, wherein at least one surface of the body portion is adapted to have a coefficient of friction below 0.4.

5. The funnel of claim 1, wherein the body portion is telescopically collapsible.

6. The funnel of claim 1, wherein the body portion is adapted to collapse like an accordion.

7. The funnel of claim 1, further comprising an attachment for an extension.

8. The funnel of claim 1, wherein the magnetic rim has at least two magnetic elements embedded therein.

9. The funnel of claim 8, wherein the magnetic rim has two pairs of magnetic elements located on opposite sides of the magnetic rim.

10. The funnel of claim 1, further comprising an insert placed within the top opening.

11. The funnel of claim 10, wherein the insert is a screen.

12. The funnel of claim 10, wherein the insert is made of cheesecloth.

13. The funnel of claim 10, wherein the insert comprises purification agent.

14. A funnel system comprising:

a funnel comprising;

a body portion having a top opening that is larger than a bottom opening, wherein the body portion is adapted to be collapsible;

a magnetic rim forming a perimeter of the top opening, wherein the magnetic rim is adapted to be secured to another magnetic surface;

wherein the magnetic rim is oval shaped and has more material forming portions of the oval shape on the portion of the oval shaped magnetic rim located along the longest axis of the oval shaped magnetic rim;

wherein the magnetic rim has at least four magnetic elements located on the portions of the oval shape having more material, wherein each of the at least four magnetic elements are arranged to correspond to corners of a rectangle and none of the at least four magnetic elements are located on the circumference of the top opening; and a magnetic component comprising a securing device and magnet that is adapted to be secured at a location where the funnel is accessible.

15. The funnel system of claim 14, wherein the magnetic rim has a loop that is adapted to attach an insert for the funnel.

16. The funnel system of claim 14, wherein the magnetic rim has two pairs of magnetic elements located on opposite sides of the magnetic rim.

17. The funnel system of claim 14, wherein the securing device comprises hook and loop tape.

* * * * *